US005524875A

United States Patent [19]

Thommen, Jr.

[11] Patent Number: 5,524,875

[45] **Date of Patent: *Jun. 11, 1996**

[54] SAFETY NET SYSTEM

[76] Inventor: Robert A. Thommen, Jr., 720 Avenida Castellano, Santa Fe, N.M. 87501

[ * ] Notice: The term of this patent shall not extend beyond the expiration date of Pat. No. 5,395,105.

[21] Appl. No.: 399,091

[22] Filed: Feb. 24, 1995

Related U.S. Application Data

[63] Continuation-in-part of Ser. No. 148,694, Nov. 5, 1993, Pat. No. 5,395,105.

[51] Int. Cl.[6] ..... E01F 7/00

[52] U.S. Cl. ..... 256/12.5; 256/13.1; 256/35

[58] Field of Search ..... 256/12.5, 23, 13.1, 256/25, 35; 188/65.1–65.4; 244/110 C, 110 F

[56] References Cited

U.S. PATENT DOCUMENTS

| | | | |
|---|---|---|---|
| 1,828,350 | 10/1931 | Williams | 256/35 |
| 4,730,810 | 3/1988 | Rambaud | 256/12.5 |
| 4,819,915 | 4/1989 | Cargnel | 256/12.5 |
| 5,299,781 | 4/1994 | Barrett et al. | 256/12.5 |
| 5,395,105 | 3/1995 | Thommen | 256/12.5 |

FOREIGN PATENT DOCUMENTS

| | | | |
|---|---|---|---|
| 2414586 | 1/1978 | France | 256/12.5 |
| 2622611 | 5/1989 | France | 256/12.5 |
| 2919582 | 11/1980 | Germany | 256/12.5 |
| 3602787 | 8/1987 | Germany | 256/12.5 |

*Primary Examiner*—Anthony Knight

[57] ABSTRACT

A safety net system placed upright on the ground for restraining rock fall. The system has at least one unit, with each unit comprising a continuous top rope and a continuous bottom rope, each of which is connected to an anchor, with each rope extending through guides on columns and at each end of the unit extending beyond the end column. Panels of woven rope netting or chain link fencing are disposed between the columns and are secured to the top and bottom ropes, with a panel that is adjacent to an end of the unit being disposed in a common plane with the top and bottom ropes that are anchored at that end.

22 Claims, 7 Drawing Sheets

SAFETY NET SYSTEM

This is a continuation-in-part application of U.S. patent application Ser. No. 08/148,694, filed Nov. 5, 1993, that will issue as U.S. Pat. No. 5,395,105.

BACKGROUND OF THE INVENTION

The present invention relates to a safety net system that is placed upright on the ground as a rock fall restraining system to form a low impact barrier for restraining rock fall.

A number of barriers for restraining falling rocks are known. For example, in U.S. Pat. No. 4,819,915, Cargnel, a flexible barrier is disclosed that is provided with posts that pivot on a ground-anchored base plate, with the posts being held by wind bracing cables, some of which extend in an upstream direction and others of which extend in a downstream direction. An arresting net is secured to a series of spaced-apart horizontal ropes that are supported by the upstream wind bracing cable. U.S. Pat. No. 4,730,810, Rambaud, discloses a protective barrier that comprises a sheet of netting that is held upright by posts that in turn are held by upstream and downstream stays that are coupled to guide means that are further coupled to a mooring cable and to shock-absorbing means.

Such known protective barriers with retaining cables that extend transverse to the plane of the barrier are necessary for high impact situations. However, for lower impact barriers, it is not necessary to have such a complicated, expensive heavy duty system. Unfortunately, the heretofore known systems for low impact barriers, such as simple diagonal chain link and hexagonal mesh fencing, can withstand only very low impact forces and are subject to frequent maintenance.

It is therefore an object of the present invention to provide a barrier or safety net system for low impact situations that is extremely effective, requires little maintenance, and is also economical.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The safety net system of the present invention is characterized by at least one unit, each of which comprises: at least two columns that are disposed in the ground, with each column being provided with spaced-apart guide means; two anchor means disposed in the ground at opposite ends of the unit; a continuous top rope and a continuous bottom rope, each of which is connected to one of the anchor means, from which it extends through a respective one of the guide means of one of the columns at a first end of the unit, through respective ones of the guide means of any interposed columns, through a respective one of the guide means of one of the columns at a second end of the unit, and to the other of the anchor means, to which the rope is also connected, whereby the top and bottom ropes at each end of the unit extend beyond the column at that end and are connected to the same anchor means; and at least one net panel comprised of woven rope netting or chain link fencing, namely diagonal chain link or hexagonal mesh fencing, which can be in the form of a single or double chain link. Each panel is disposed between two of the columns and is secured to the top and bottom ropes, with any panel that is adjacent to one of the ends of the unit being disposed in a common plane with the top and bottom ropes that are anchored at that end.

The inventive safety net system has several unique features. In particular, there are no retaining cables that extend transverse to the plane of at least the end net panels. Furthermore, the top and bottom support ropes are each continuous ropes, extending from one anchor, throughout the entire unit, which can be made up of several net panels, to the opposite anchor. Thus, the support ropes are not looped around the columns. The inventive system is unexpectedly inexpensive, and in particular is highly effective. In addition, maintenance is reduced to a minimum.

Further specific features of the inventive safety net system will be described in detail subsequently.

DESCRIPTION OF PREFERRED EMBODIMENTS

Figure 1:
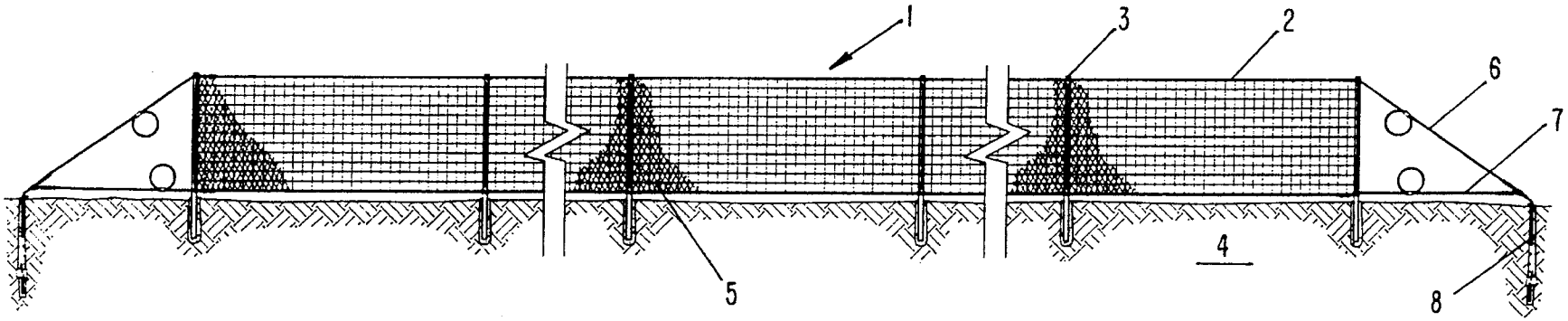
FIG. 1 illustrates one exemplary embodiment of the inventive safety net system.

Referring now to the drawings in detail, FIG. 1 shows a unit 1 composed of five essentially planar, woven net panels 2 to form one exemplary embodiment of the inventive safety net system in the form of a rock fall restraining system that forms a low impact barrier and is comprised of at least one unit 1 having at least one of the net panels 2. Columns or posts 3 are disposed upright in the ground or bedrock 4, with the net panels 2 being disposed between the columns 3 in a manner to be discussed in detail subsequently. Chain link fencing material 5 is advantageously secured to the net panels 3 on the uphill side thereof. A continuous top support rope 6, which is preferably a wire rope, and a similar continuous bottom support rope 7, respectively extend from one anchor means 8 that is disposed beyond one end of the unit 1 all the way to a second anchor means 8 that is disposed beyond the opposite end of the unit 1.

Figure 2:
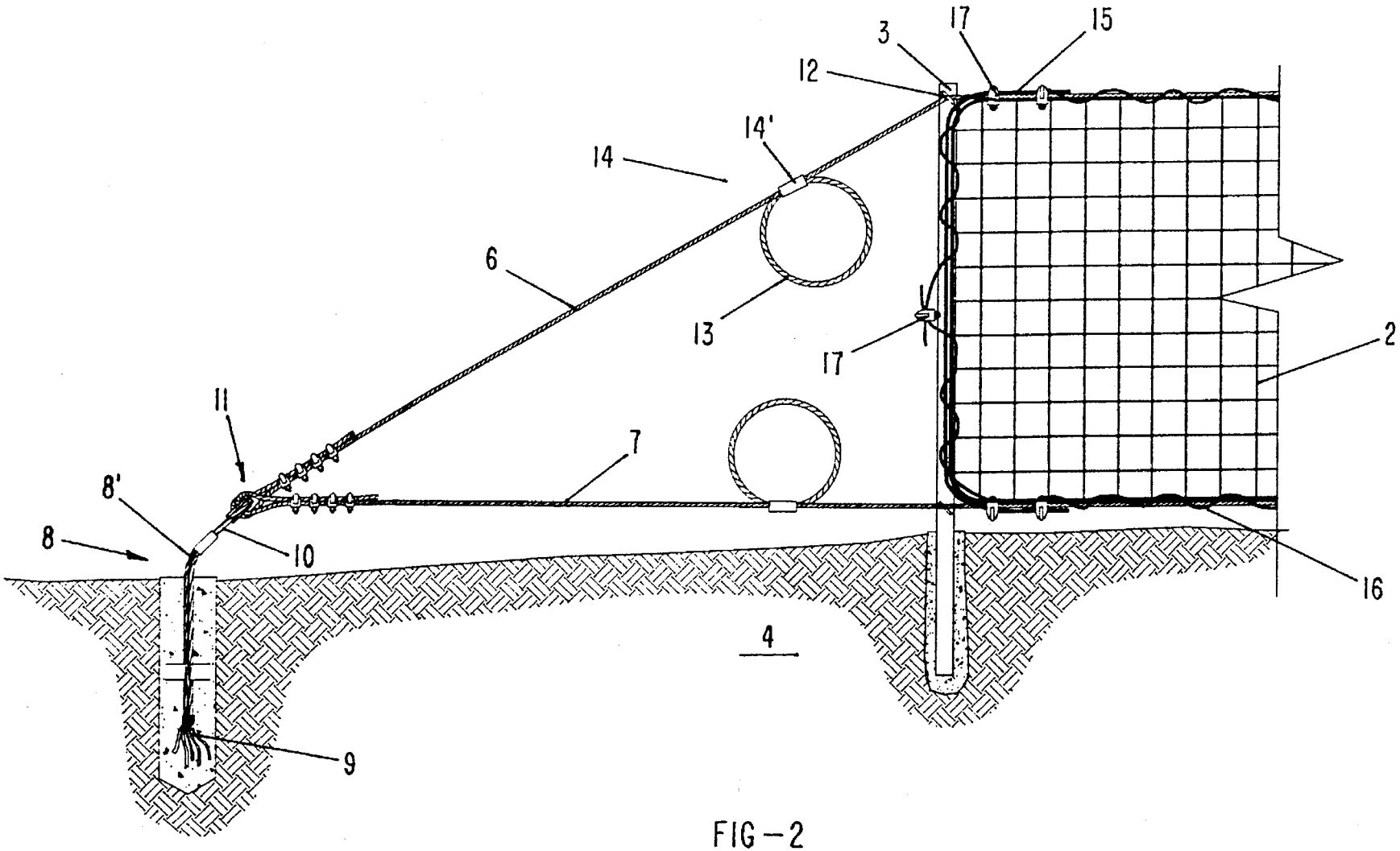
FIG. 2 is a partial end view of the system of FIG. 1.

As can be seen from the enlarged end view of FIG. 2, which is actually the downhill-facing side, the anchor means 8 comprises, for example, a wire rope anchor 8' that together with a preferably splayed end 9 is anchored in concrete poured into a hole in the ground 4. The anchor means 8 also has a loop end 10, which is provided with a rope protector within the loop. The ends of the top and bottom support ropes 6 and 7 are looped through the loop end 10 as indicated by the arrow at 11 and are thereupon connected to themselves, for example by means of four wire rope clips. The anchor means 8 could also be a screw type anchor, which is advantageously used in easy-to-drill ground. With such an anchor, the loop end 10 is formed or otherwise attached to a threaded bolt that is then screwed into the ground or into a hole drilled into the ground.

Guide means 12, for example in the form of heat treated, high strength U-bolts, are provided on the columns 3 for the support ropes 6 and 7. The columns 3 are preferably profiled, for example having an H-shaped cross-sectional configuration, with the U-bolts 12 then being bolted thereto. As can be seen from FIG. 2, the guide means or U-bolts 12 are preferably disposed at an angle, for example 45°, to the longitudinal axis of the columns 3. Furthermore, as indicated previously, the U-bolts 12 are to be disposed on the downhill side of the system.

Figure 5:
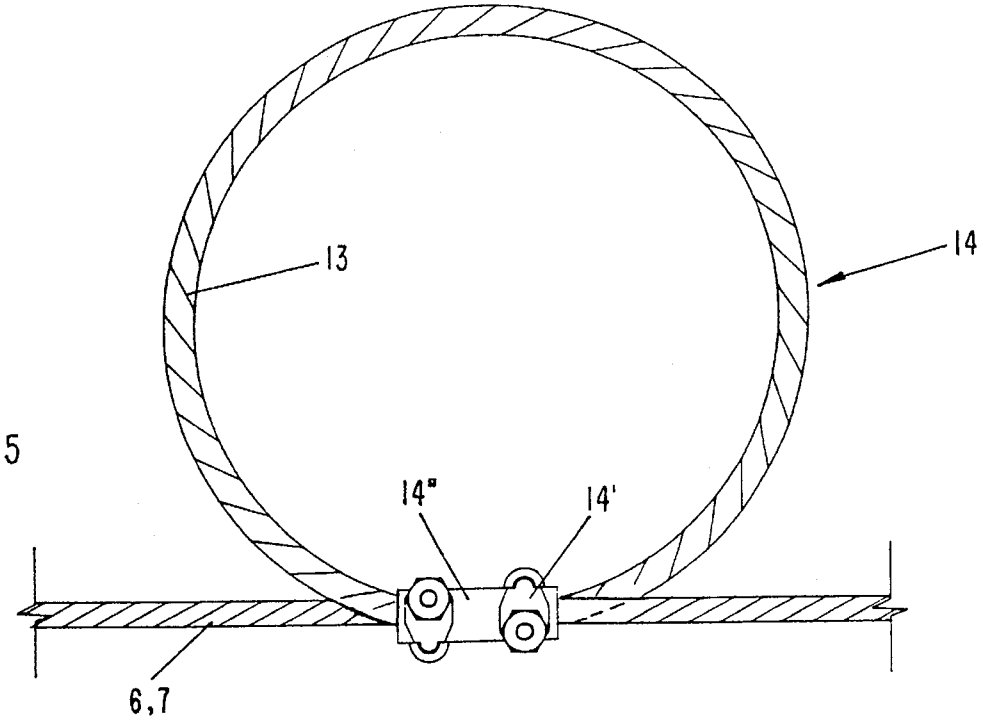
FIG. 5 is a side view of one embodiment of a brake element for the systems of FIGS. 1 and 4.
Figure 6:
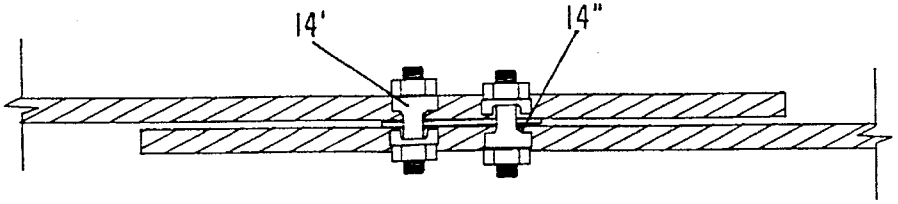
FIG. 6 is a cross-sectional view of the braking element of FIG. 5.

Braking elements 14, for example in the form of friction brakes or dampening means, are provided on the top and bottom support ropes 6 and 7 between the end column 3 and the anchor means 8. The top and bottom support ropes 6 and 7 are formed into loops 13 at these locations, with the loops being held in place by tensioned clamps 14' and a friction plate 14" (see in particular the detailed views of FIGS. 5 and 6). These braking elements 14 allow the net panels 2 to absorb the impact of rocks or the like; in particular, the net panels 2 can bulge or deflect with the aid of the braking elements 14, which allow the loops 13 to close up when a predetermined tensile load is applied to the pertaining support rope 6 or 7. The provision of separate support ropes 6, 7 is very important for maximizing the ability of the inventive safety net system to absorb impacts without being destroyed or severely damaged.

Figure 3:
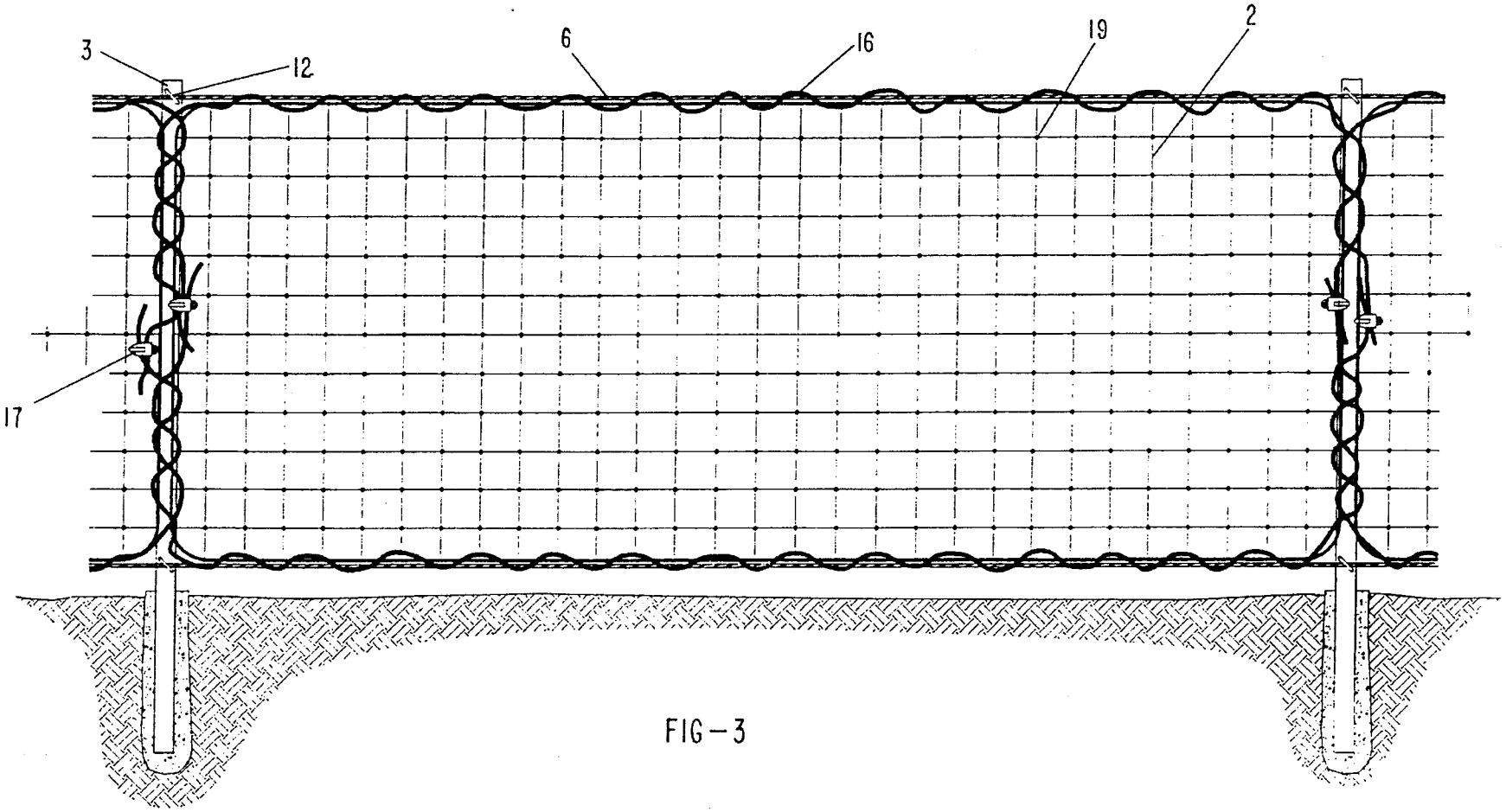
FIG. 3 shows how adjacent net panels of the system of FIG. 1 are seamed together.

As can be seen from FIG. 2, the end net panels 2 are provided with an end support rope 15, the ends of which are then secured to the top and bottom support ropes 6 and 7 respectively, while the net panels 2 themselves are secured to the end support ropes 15 and to the top and bottom support ropes 6 and 7 by seam ropes 16 only, i.e. without the use of movement-restricting clips. The ends of the seam ropes 16 are clipped together by wire rope clips 17. Similar rope clips 17 secure the end support rope 15 to the top and bottom support ropes 6 and 7. As shown in FIG. 3, adjacent intermediate net panels 2 are not provided with the end support ropes 15. Rather, the adjacent net panels 2 are seamed together by the seam ropes 16, via which the net panels 2 are also secured to the top and bottom support ropes 6 and 7. It should be noted that the net panels 2 are never seamed to the columns 3, with the seam ropes 16 therefore being disposed on only one side of the column, namely the downhill side of the system. In a preferred embodiment of the present invention, each net panel 2 is provided with two seam rope sections that are then interconnected at each end of the net panel by the clips 17. In this connection, although the seam ropes 16 of a given net panel 2 are interwoven with the adjacent net panel 2, seam rope sections are interconnected to other seam rope sections of the same net panel.

The critical feature of the present invention, as can be seen, for example, in FIGS. 1 and 2, is that each end net panel 2 of a unit 1 is disposed in the same plane as the top and bottom support ropes 6 and 7 that are anchored at that end. Thus, in distinct contrast to the heretofore known safety net systems, the inventive system has no anchors or support means that extend transverse to the plane of the end net panel.

Figure 4:
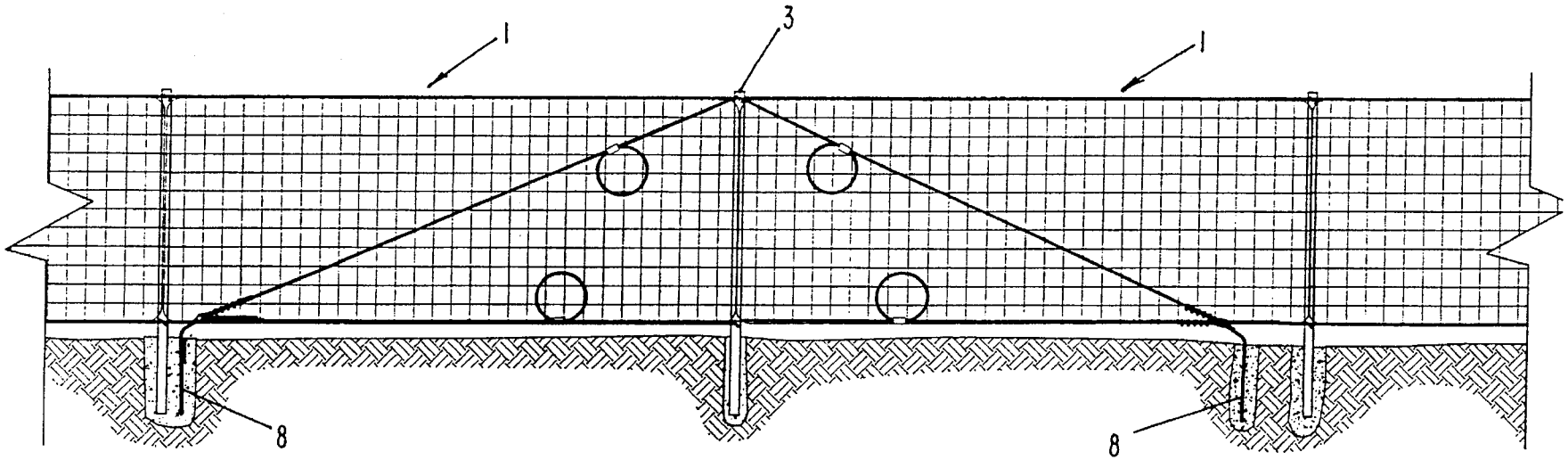
FIG. 4 illustrates an exemplary embodiment of the inventive safety net system showing two adjacent units.

Each unit 1 comprises at least one net panel 2, for example of up to 20 feet in length, and can also comprise a plurality of net panels 2, for example a maximum of five 20 foot panels, such as is indicated in FIG. 1. If necessary in order to accommodate the terrain, the net panels 2 of a given unit 1 can be disposed at an angle relative to one another, with the proviso that the end net panels 2 be disposed in a common plane with the top and bottom support ropes 6, 7 that are anchored at that end. Several abutting units 1 can also be provided. In such a case, the adjacent units 1 could have their end net panels 2 abut one another, and could even share a common column 3 (see FIG. 4). In such a case, the adjacent end panels 2 could be seamed together via seam ropes 16. In addition, the top and bottom support ropes 6, 7 of one of the units 1 overlaps the end net panel 2 of the adjacent unit 1. As can be seen from FIG. 4, the anchor means 8 for the top and bottom support ropes 6, 7 can be anchored in the ground 4 in several ways. For example, as shown on the left side of FIG. 4, the anchor means 8 can share a hole with the column 3 that is disposed at the far end of the end net panel 2 of the adjacent unit 1, being embedded in the same concrete as is this column 3; this is the preferred configuration. Alternatively, as shown at the right side of FIG. 4, the anchor means 8 can be anchored in concrete provided in a separate hole.

With respect to the anchoring of the columns 3, this also can be accomplished in several different ways. For example, the column 3 can be directly disposed in a hole that is filled with concrete. Another possibility is to connect the post to a plate that is then disposed on a concrete pad for leveling purposes, with the plate being anchored via bolts that extend deep into the ground, especially into bedrock. A further possibility would be to dispose the bottom of the column in a sleeve that is then in turn disposed in a hole that is filled with concrete. Yet another possibility is to have a bottom post section to which is welded a vertically extending plate. This bottom post section and plate are driven into the ground, generally fairly soft ground, whereby the plate is disposed on the downhill side. The top, normal post is connected to a horizontal plate that is also connected to the top of the bottom post section.

As mentioned previously, and as can be seen in particular in FIG. 3, adjacent net panels 2 are interconnected by seam ropes 16. The seam rope sections of a given net panel 2 interweave the two adjacent net panels together. In the embodiment illustrated in FIG. 3, each net panel 2 has two seam rope sections that are then interconnected at both sides by the clips 17; in the illustrated embodiment, the sections of the seam ropes 16 are clipped together on the opposite side of the column 3. It is important to repeat that although seam ropes interweave the two adjacent net panels 2, these seam ropes 16 are not wound around the column 3, and are therefore disposed on only one side of the column, namely the downhill-facing side.

Figure 7:
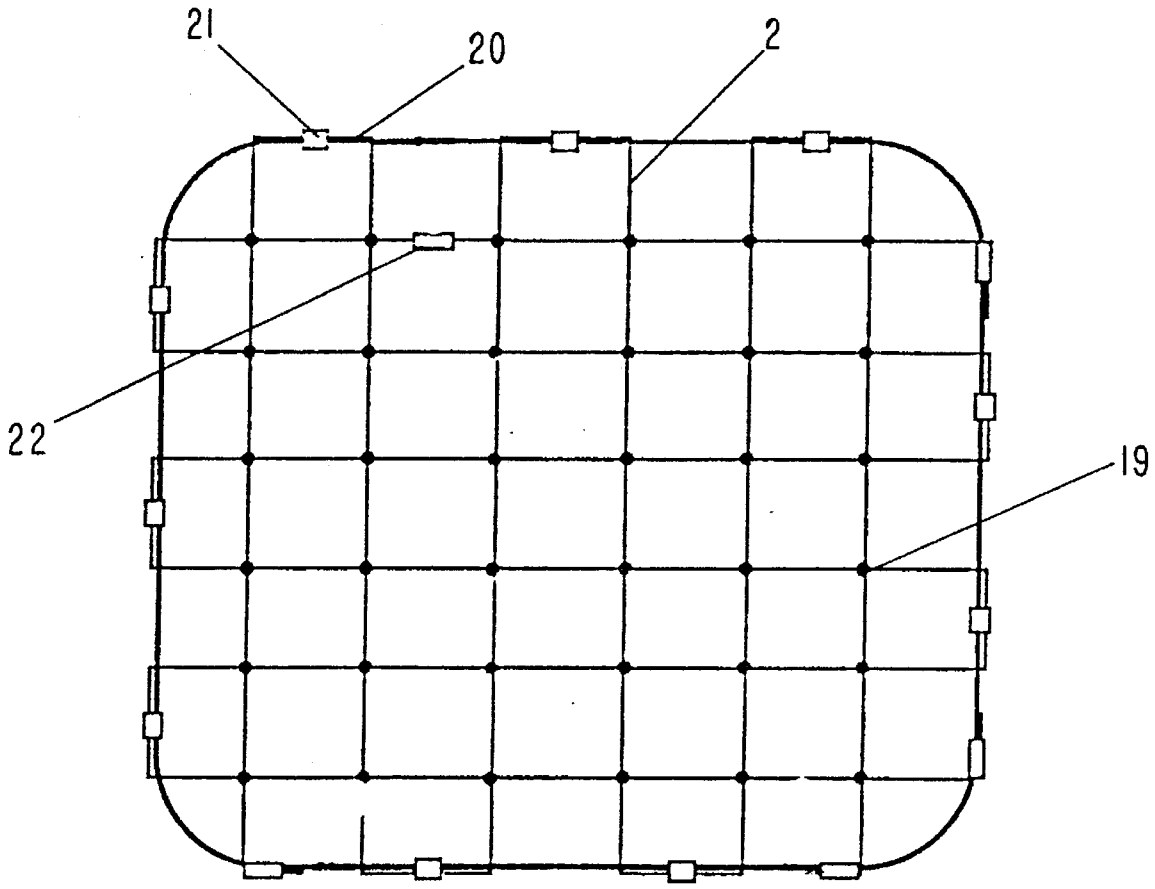
FIG. 7 shows the construction of a woven net panel of the inventive system.

As indicated previously, the net panels 2 comprise a woven netting, for example a woven eight inch by eight inch (or twelve inch by twelve inch for even lower impact forces) straight mesh netting made from a single wire rope having only one joint 22 (see FIG. 7), such as a stop sleeve. Overlapping sections of the wire rope are secured to one another by clips, for example cross clips 19 such as those indicated in FIGS. 3 and 7. In addition, the netting is clipped to a border rope 20, for example via C-clamps 21. The thus completed net panel 2 is then seamed to the top and bottom support ropes 6 and 7 by seam ropes 16, which also seam the net panel 2 to an adjacent net panel if one is present, or to an end support rope 15 as illustrated in FIG. 2.

The top and bottom support ropes 6 and 7, the ropes of the net panels 2, the end support ropes 15, as well as the seam ropes 16, are preferably wire ropes. By way of example, the top and bottom support ropes 6 and 7 can be of one-half inch diameter, as can be the end support ropes 15, while the seam ropes 16 and the ropes of the net panels 2 can, for example, have a diameter of from 3/16 to 5/16 of an inch.

Figure 8:
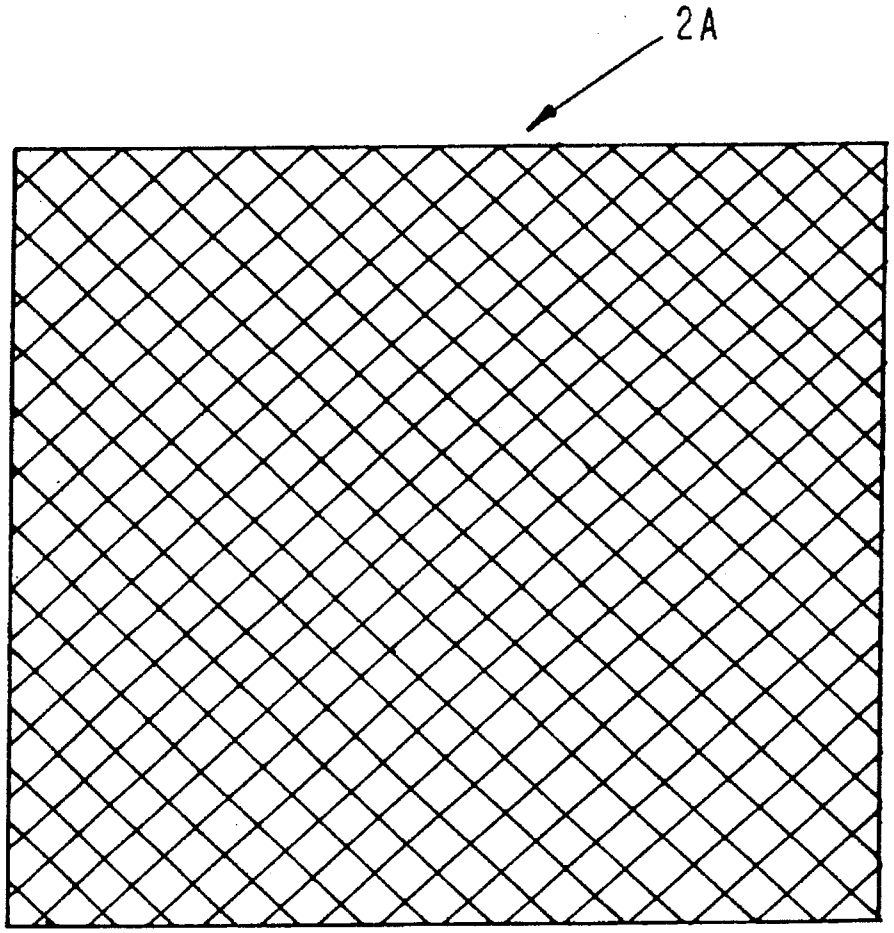
FIG. 8 shows the construction of a chain link fencing panel of the inventive system.

However, although the inventive safety net system has been described in conjunction with the use of woven net panels 2, it would also be possible to use panels comprised of a chain link fence type, at least in particularly low impact situations. FIG. 8 shows one exemplary embodiment of such a panel 2A that is seamed or otherwise attached to the top and bottom support ropes 6 and 7 in a manner similar to that described in conjunction with the woven net panel 2.

Furthermore, as was indicated previously, a chain link fencing 5 is expediently disposed on the uphill side of each net panel 2 in order to better distribute the impact load to the wire rope netting of the panels, and also to retain smaller material. The chain link fencing 5 can have a double twist hexagon configuration with, for example, a two inch by two inch mesh. The chain link fencing 5 is secured to the net panel 2 by clips, especially via so-called "hog rings".

The present invention is, of course, in no way restricted to the specific disclosure of the specification and drawings, but also encompasses any modifications within the scope of the appended claims.

What I claim is:

1. A safety net system placed upright on the ground for restraining rock fall and comprised of at least one unit, each of which comprises:

at least two columns disposed in said ground, with each column being provided with spaced-apart guide means;

two anchor means disposed in said ground at opposite ends of said unit;

a first continuous top rope and a second, separate continuous bottom rope, each of which is connected to one of said anchor means, from which it extends through a respective one of said guide means of one of said columns at a first end of said unit, through respective ones of said guide means of any interposed columns, through a respective one of said guide means of one of said columns at a second end of said unit, and to the other of said anchor means, to which said rope is also connected, whereby said top and bottom ropes at each end of said unit extend beyond said column at that end and are connected to the same anchor means; and at least one net panel, each panel being disposed between two of said columns and being secured to said top and bottom ropes, with any panel that is adjacent to one of said ends of said unit being disposed in a common plane with said top and bottom ropes that are anchored at that end.

2. A safety net system according to claim 1, wherein respective braking and dampening means are disposed on said top and bottom ropes.

3. A safety net system according to claim 2, wherein said braking and dampening means comprises a loop of said top or bottom rope and a clamp means that is disposed on said rope and is tensioned to maintain said loop thereof up to a predetermined tensile load.

4. A safety net system according to claim 2, wherein seam rope means are provided to effect said securement of said net panels to said top and bottom ropes.

5. A safety net system according to claim 1, wherein said columns are profiled.

6. A safety net system according to claim 5, wherein said guide means are respective U-bolts that are secured to one of said columns.

7. A safety net system according to claim 6, wherein each of said U-bolts is disposed at an angle of about 45° relative to a longitudinal direction of said column to which said U-bolt is secured.

8. A safety net system according to claim 1, wherein said anchor means comprises a wire rope anchor that is disposed in said ground and has a loop end to which said top and bottom ropes are connected.

9. A safety net system according to claim 1, wherein each of said net panels is comprised of woven rope netting.

10. A safety net system according to claim 9, wherein overlapping ropes of said woven netting of said net panels are interconnected via cross clips.

11. A safety net system according to claim 9, wherein an end portion of a net panel that is adjacent to one of said ends of said unit is provided with an end support rope, ends of which are secured to said top and bottom ropes respectively.

12. A safety net system according to claim 11, wherein said net panel is secured to said end support rope via seam rope means.

13. A safety net system according to claim 11, wherein said top and bottom ropes said end support ropes, said seam rope means, and ropes of said woven netting of said net panels are wire ropes.

14. A safety net system according to claim 9, wherein each net panel includes chain link fencing attached to one side thereof.

15. A safety net system according to claim 14, wherein said chain link fencing is attached to said net panel via hog rings.

16. A safety net system according to claim 1, wherein each of said units comprises several net panels.

17. A safety net system according to claim 16, wherein adjacent ones of said net panels of a given unit are seamed together via seam rope means but are not seamed to said column that is disposed between said adjacent net panels.

18. A safety net system according to claim 17, wherein adjacent ones of said net panels are disposed at an angle to one another.

19. A safety net system according to claim 17, which comprises at least two units.

20. A safety net system according to claim 19, wherein ends of said units are disposed adjacent to one another, and said top and bottom ropes of one of said units overlaps one of said net panels of an adjacent one of said units.

21. A safety net system according to claim 20, wherein adjacent ones of said units share a common one of said columns, with said net panels of each of said adjacent units that are adjacent to said shared column being seamed together via seam rope means but are not seamed to said shared column.

22. A safety net system according to claim 1, wherein each of said net panels is comprised of chain link fencing.

* * * * *